United States Patent [19]

Shimizu

[11] Patent Number: 4,458,230

[45] Date of Patent: Jul. 3, 1984

[54] MAGNETIC DEVICE

[75] Inventor: Masami Shimizu, Tokyo, Japan

[73] Assignee: Canon Kabushiki Kaisha, Tokyo, Japan

[21] Appl. No.: 322,551

[22] Filed: Nov. 18, 1981

[30] Foreign Application Priority Data

Nov. 26, 1980 [JP] Japan ..... 55-168903[U]

[51] Int. Cl.[3] ..... H01F 7/08

[52] U.S. Cl. ..... 335/271; 335/277

[58] Field of Search ..... 335/247, 248, 249, 257, 335/271, 273, 277

[56] References Cited

U.S. PATENT DOCUMENTS

| | | | |
|---|---|---|---|
| 2,735,967 | 2/1956 | Lewus | 335/247 X |
| 2,986,662 | 5/1961 | Wahl | 335/271 X |
| 3,479,627 | 11/1969 | Underwood | 335/277 X |
| 4,131,865 | 12/1978 | Hart | 335/277 X |

*Primary Examiner*—George Harris

*Attorney, Agent, or Firm*—Toren, McGeady and Stanger

[57] ABSTRACT

A magnetic device is arranged so that by supplying current to coils provided on a yoke, an armature is attracted to the yoke, and by interrupting the current supply to the coils, the armature is separated from the yoke. A precious metal coating is provided at least on one of the attracting surfaces of the yoke and the armature. This arrangement allows the armature to smoothly disengage from the yoke, and provides corrosion resistivity.

5 Claims, 3 Drawing Figures

MAGNETIC DEVICE

BACKGROUND OF THE INVENTION

1. Field of the Invention

The present invention relates to a magnetic device, and particularly to a so-called release type magnetic device having improved attraction stability for use in camera shutters.

2. Description of the Prior Art

In a magnetic device used for controlling the camera shutter time and the like, a current is initially supplied to coils provided on the device's yoke, and when the current supply is interrupted, the armature is disengaged from the yoke by a return spring to cause disengagement of a member that has prevented the shutter's running movement.

In the above-mentioned release type magnetic device, the time period from interruption of the current supply to the coils, until the armature is disengaged from the yoke in order to operate other members, must be small and stable.

Generally, a magnetic device that frequently exercises magnetic attraction, for example, a device to control a shutter mechanism, requires a high durability attracting surface, so that a large attracting surface as a whole is needed. However, when the attracting surface is large, it is difficult for the armature to be disengaged from the yoke, even after interruption of the current supply. This is inconvenient.

Accordingly, in order to eliminate the above-mentioned inconvenience, it is desirable that an air gap should be formed in the state in which the yoke attracts the armature.

In order to obtain such an air gap in a stable manner, it is best to plate the magnetic metal. Further, with such a metal layer, a shock absorbing effect can be obtained at the time of attraction, which further contributes to durability.

However, with conventional copper plating, it is difficult to obtain sufficient thickness and durability which is inconvenient. Further, in order to increase the corrosion resistivity, it is necessary to plate with chrome and the like.

SUMMARY OF THE INVENTION

An object of the present invention is to offer a magnetic device comprising a yoke, an armature to be attracted to or disengaged from the yoke, and urging means for urging the armature in the direction along which the armature is separated from the yoke, wherein a precious metal is plated at least on one attracting surface of the yoke or armature, in order to substantially increase durability and corrosion resistivity.

Another object of the present invention is to eliminate the above-mentioned problems by adopting silver as the precious metal.

Further, another object of the present invention is to eliminate the above-mentioned problems by adopting gold as the precious metal.

Further, another object of the present invention is to eliminate the above-mentioned problems by adopting platinum as the precious metal.

Other objects and advantages will become obvious when reference is had to the accompanying drawings.

DESCRIPTION OF THE EMBODIMENTS

Below, the present invention will be explained in detail in accordance with the drawings of an embodiment thereof.

Figure 1:
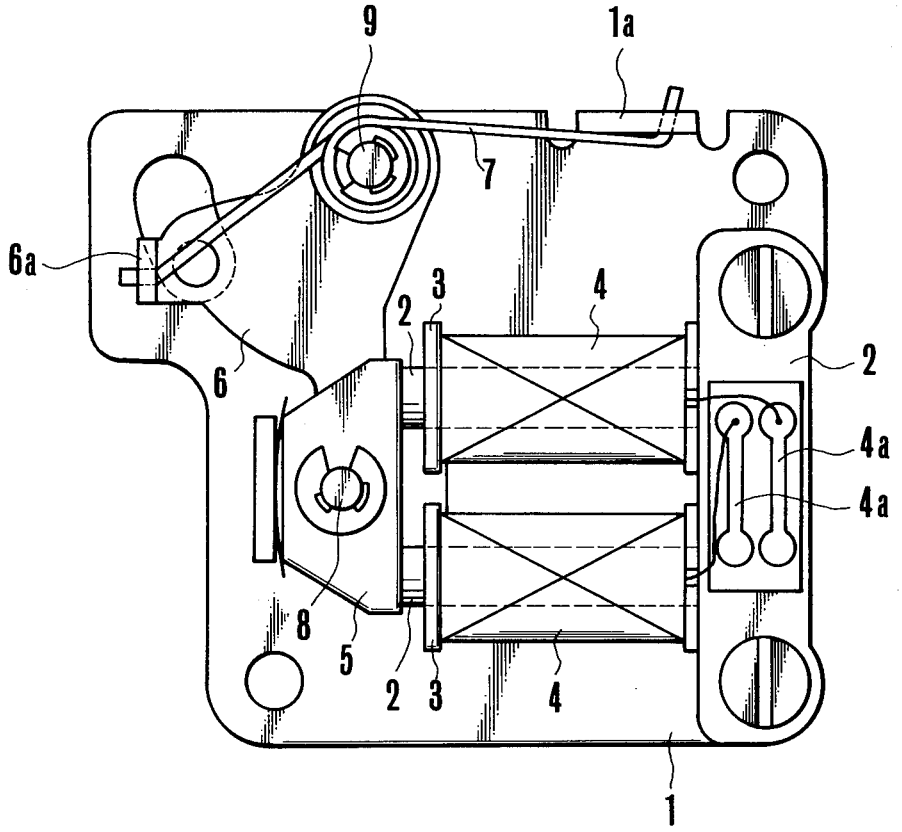
FIG. 1 is an elevational view of the magnetic device of the present invention.

FIG. 1 shows an example of the magnetic device in accordance with the present invention.

In the drawing, a base plate 1 has a U-shaped yoke 2 secured on the base plate. Bobbins 3 are provided on the two arms of the yoke 2, and coils 4 are provided on the bobbins.

The coils are connected to a control circuit (not shown) for the magnet via terminals 4*a*. An armature 5 is rotatably held on the armature lever 6 by means of the shaft 8. and, the armature lever 6 is rotatably held by means of the shaft 9. A return spring 7 is provided between a part 6*a* of the armature lever and a part 1*a* of the base plate, in such a manner that the armature lever 6 is urged along the clockwise direction in the drawing by means of the return spring 7. Thus, the armature 5 is normally urged in the direction along which the armature 5 is separated from the yoke 2.

Because the magnetic device is constructed as mentioned above, when the coils 4 are excited by means of the magnet control circuit, the armature 5 is attracted by the yoke 2. When the coils 4 are not in the excited state, the armature 5 is separated from the yoke by means of the force of the return spring provided on the armature lever 6, wherein the given lock claw members (not shown) are disengaged.

In the above-mentioned magnetic device, it is desirable to improve the stability of attraction between the yoke 2 and the armature 5, and to obtain a quick and stabilized disengagement.

Figure 2:
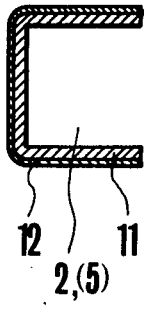
FIG.2 (PRIOR ART)
FIG. 2 is a sectional view of a conventional attracting surface.

FIG. 2 shows an important part of the conventional magnetic device in section. In the drawing, numerals 2 and (5) correspond to the yoke 2 and the armature 5 in FIG. 1. A copper coating 11 with thickness not thicker than 1 $\mu$m is provided on the attracting surface of the yoke or armature, and a chrome coating 12 with a thickness of about 0.1 $\mu$m is provided on the copper coating for corrosion proofing.

By means of the above construction, a magnetic air gap is produced in the magnetic circuit, in the state in which the armature and the yoke attract each other, in such a manner that when the current supply to the magnet is interrupted, the armature separates from the yoke smoothly.

Hereafter, the separability of the armature from the yoke is generally called "cut characteristics".

On the other hand, the construction shown in FIG. 2 has the following shortcomings.

First, although the copper coating a nonmagnetic substance and low in price, its mechanical strength and durability is low.

Next, because the chrome coating high in hardness is provided on the copper coating which is low in mechanical strength and durability for corrosion proofing, there is a danger that the chrome coating will be worn off after repeated attraction of the yoke with the armature.

Further, because two kinds of coatings are provided, the coating irregularity is doubled, which means the total thickness of the magnetic coating, namely the air gap formed by the attracting surface between the yoke and the armature becomes unavoidably irregular and, therefore, regular distribution of the attracting force cannot be obtained. Consequently, stabilized operational characteristics cannot be obtained.

Figure 3:
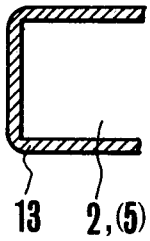
FIG. 3 is a sectional view of an attracting surface in accordance with an embodiment of the present invention.

FIG. 3 shows the attracting surface of the yoke or the armature in accordance with the present invention, in section.

A coating layer 13 consisting of a precious metal such as gold, silver, platinum and the like, provides only one coating at least on the attracting surface of the yoke 2 or the armature 5. The difference from the coating in FIG. 2 lies in the above. In accordance with the present invention, a precious metal is used as the coating material and therefore the price is high. However, in comparison with the conventional method it is unnecessary to coat twice. Thus, the number of the manufacturing processes is decreased so that the manufacturing cost remains almost unchanged. (In view of the price, among the precious metals, silver is most recommendable).

Further, because a precious metal is used, high corrosion resistivity can be obtained, while only one coating is carried out so that high durability can be achieved Furthermore, a comparatively precise and even air gap can be obtained. Consequently, an uneven air gap due to an irregular coating thickness can be avoided, while the cut characteristics between the armature and the yoke can be improved. This is very profitable for realizing a stabilized high speed release type magnetic device.

What is claimed is:

1. A magnetic device comprising:

(a) a yoke;

(b) coils provided on the yoke and arranged to be excited by a supply of current;

(c) an armature, said armature being arranged for movement so as to be selectively attracted and separated relative to the yoke;

(d) urging means for urging the armature in the direction along which the armature is separated from the yoke; and (e) a precious metal layer plated at least at one of the attraction surfaces of the yoke and the armature which surfaces confront one another when the armature is attracted to the yoke.

2. A magnetic device in accordance with claim 1, wherein the precious metal layer is a silver plating.

3. A magnetic device in accordance with claim 1, wherein the precious metal layer is a gold plating.

4. A magnetic device in accordance with claim 1, wherein the precious metal layer is a platinum plating.

5. A magnetic device comprising:

(a) a yoke;

(b) coils provided on the yoke and arranged to be excited by a supply of current;

(c) an armature, said armature being arranged for movement so as to be selectively attracted and separated relative to the yoke; whereby said armature is attracted by the yoke when a current is supplied to the coils;

(d) urging means for urging the armature in the direction along which the armature is separated from the yoke, so that the armature is separated from the yoke by the urging means when the current supply to the coils is interrupted; and (e) a precious metal layer plated at least at one of the attraction surfaces of the yoke and the armature which surfaces confront one another when the armature is attracted to the yoke.

* * * * *